US005967227A

United States Patent [19]

Jensen et al.

[11] Patent Number: 5,967,227

[45] Date of Patent: Oct. 19, 1999

[54] PLATE HEAT EXCHANGER

[75] Inventors: Benny Jensen, Egtved; Ellgaard Søe Pedersen; Jes Petersen, both of Kolding, all of Denmark

[73] Assignee: APV Heat Exchanger A/S, Kolding, Denmark

[21] Appl. No.: 08/973,049

[22] PCT Filed: Jun. 6, 1996

[86] PCT No.: PCT/DK96/00243

§ 371 Date: Dec. 17, 1997

§ 102(e) Date: Dec. 17, 1997

[87] PCT Pub. No.: WO96/39605

PCT Pub. Date: Dec. 12, 1996

[30] Foreign Application Priority Data

Jun. 6, 1995 [DK] Denmark ..... 0635/95

[51] Int. Cl.[6] ..... F28F 3/08

[52] U.S. Cl. ..... 165/78; 165/167; 165/DIG. 365; 165/DIG. 367

[58] Field of Search ..... 165/78, 166, 167, 165/DIG. 365, DIG. 367

[56] References Cited

U.S. PATENT DOCUMENTS

| | | | |
|---|---|---|---|
| 2,550,339 | 4/1951 | Eherman | 165/167 |
| 4,373,579 | 2/1983 | Jernqvist et al. | 165/167 |

FOREIGN PATENT DOCUMENTS

| | | |
|---|---|---|
| 0 450 822 | 10/1991 | European Pat. Off. . |
| 2 107 845 | 5/1983 | United Kingdom . |

*Primary Examiner*—Allen Flanigan
*Attorney, Agent, or Firm*—Leydig, Voit & Mayer, Ltd.

[57] ABSTRACT

Plate heat exchanger (1) comprising a plurality of rectangular plate elements (2) and intermediary gaskets (3) held clamped in a stack (4). At least two diagonally opposed corners (7) of each plate (2) in the stack (4), comprise depressed corner areas, which are connected to the inner plate area at a concave bending line (9). The outer contour of the depressed corner area of a plate (2) in the stack (4) is in positive engagement with the inner contour of the depressed corner area of the next following plate (2) in the stack (4). This ensures alignment of the stack, both during assembly and during subsequent use.

8 Claims, 3 Drawing Sheets

PLATE HEAT EXCHANGER

FIELD OF THE INVENTION

The present invention concerns a plate heat exchanger comprising a plurality of rectangulary plate elements and intermediary gaskets to be held clamped in a stack, wherein the plate elements and gaskets define flow channels for the heat exchanging media flowing through the plate heat exchanger, which flow channels are to be filled via aligned inflow and outflow openings in the plates.

CLOSEST PRIOR ART

The commonly used plate heat exchangers of today generally comprise 4–600 plates in the same stack, but it is not unusual that as many as 1000 plates are clamped together in the same heat exchanger stack.

Due to often high pressures and temperatures in the heat exchanger media during use, it is on the one hand necessary that the plates and intermediary gaskets of the stack are held together by means of high clamping forces, so that tightness of the flow channels is ensured.

But on the other hand, the clamping forces, which can assume very high values on some of the plates in the stack, inevitably apply high lateral forces on the plates in question with the danger of laterally displacing these, so to say out of the stack.

At worst, the result can be subsequent uncontrolled distortion of the plate stack and therefore leakage in the flow channels.

Therefore, experience has shown that it is of the outmost importance that the plates are always properly aligned, both during clamping action and during subsequent use to avoid distortion of the plate stack and thereby undesirable failure of the heat exchanger.

The slightest misalignment of the plates in the stack also cause misalignment of the succeeding intermediary gaskets. The high clamping force will therefore be unevenly distributed from one gasket to the next following gasket in the stack, which gives rise to transverse forces acting between the plates and the intermediary gaskets, involving a risk of leakage in the flow channels. In extreme cases tilting of the gaskets can take place and damage of both the gaskets and the plates can occur as a result thereof.

To avoid misalignment of the plates in the stack, it is known to guide the plates in alignment arrangements of different configurations.

A commonly used alignment arrangement comprises upper and lower guide bars connected at the ends to clamping means. The upper and lower guide bars engage in openings or cutouts symmetrically placed at the upper and lower edges of the plates, respectively.

Owing to the inevitable manufacturing tolerances of the cut-outs, of the depressed plates and of the gaskets disposed therebetween, a uniform action of the high clamping force over the entire plate area, and therefore over the plate periphery, is impossible. Individual plates in the stack are therefore influenced by forces directed transversally to the clamping direction.

With the above-mentioned design, the transverse forces can increase to such an extent that leakage occurs between the plates and the adjacent gaskets, or even such that the plate in question breaks out laterally of the stack with respect to the guide bars.

The transverse forces further give rise to frictional forces acting between the guide bars and the plate material adjoining the cut-outs, whereby the plates are prevented from further sliding on the guide bars when the clamping force is increased even higher.

The frictional forces are therefore accumulated over the length of the plate stack, which inevitably leads to an increase in the clamping force acting on the plate in question, involving the further risk of the plate being pressed laterally out of the stack.

A further aggravating factor giving rise to higher transverse slidability of the plates, is that the opposing surfaces of the gaskets and the plates often comprise frictionally reducing compounds for easier disassembly of the stack.

In order to avoid the above-mentioned problems, several other constructions of heat exchanger plates with alignment arrangements in the form of mutually engaging plate parts have been proposed.

One of these constructions is described in GB 2 107 845 A, wherein the aligned inflow or outflow openings of the plates in the stack are provided with a collar piece, the outer contour of which is in engagement with the inner contour of the collar of the next following plate in the stack. According to the technical teaching of this construction, the collar pieces should essentially extend over the part of the opening which is remote from the inner plate area. In other words, the collar pieces should have a convex extension with respect to the inner plate area.

Experience has shown that this construction has not been able to solve the above-mentioned problems either. On the contrary, there is still the possibility of misalignment of the stack, due to laterally mutual sliding of adjacent plates.

OBJECT

The object of the invention is to provide a plate heat exchanger which can be assembled in a fast and simple way without lack of reliable alignment of the plate stack, and which moreover operates safely and reliably in use.

NOVELTY OF THE INVENTION

The plate heat exchanger of the present invention is characterized in that at least two diagonally opposed corners of each plate in the stack have depressed corner areas comprising collar parts, which are connected to the inner plate area at a bending line, which line extends substantially from one peripheral plate edge to the other adjacent peripheral plate edge of the corner with a concave extent in relation to the inner plate area, and wherein the outer contour of the collar parts of a plate in the stack is in positive engagement with the inner contour of the collar parts of the next following plate in the stack.

ADVANTAGES

This results in a plate heat exchanger with a particular reliable tightness of the flow channels in use, and which can be assembled as well as disassembled in an unprecedented fast and convenient manner.

MODE OF OPERATION

The positive engagement between the outer contours of diagonally opposed corners of a plate, and the inner contours of diagonally opposed corners of the next following plate in the stack, ensure a fast assembly where the plates are guided in a safe manner into engagement with each other. The concave extent of the collar parts furthermore ensures that the plates are always in firm inter-locking engagement with each other, preserving alignment of the stack irrespective of dimensional plate variations within the production tolerances.

Testing of the inventive plate heat exchanger, under extreme heat and pressure conditions, has shown a surprisingly stable and reliable alignment of the plates in the stack with negligible transverse displacement of these, both in transverse directions parallel to the edges of the plates, as well as in rotational directions round the inner plate area.

ADVANTAGEOUS EMBODIMENTS

Expedient embodiments according to the invention are defined in the subclaims 2–8.

DESCRIPTION OF THE DRAWING

The invention will be explained more fully below with reference to the drawing, in which.

DETAILED DESCRIPTION OF AN ADVANTAGEOUS EMBODIMENT

Figure 1:
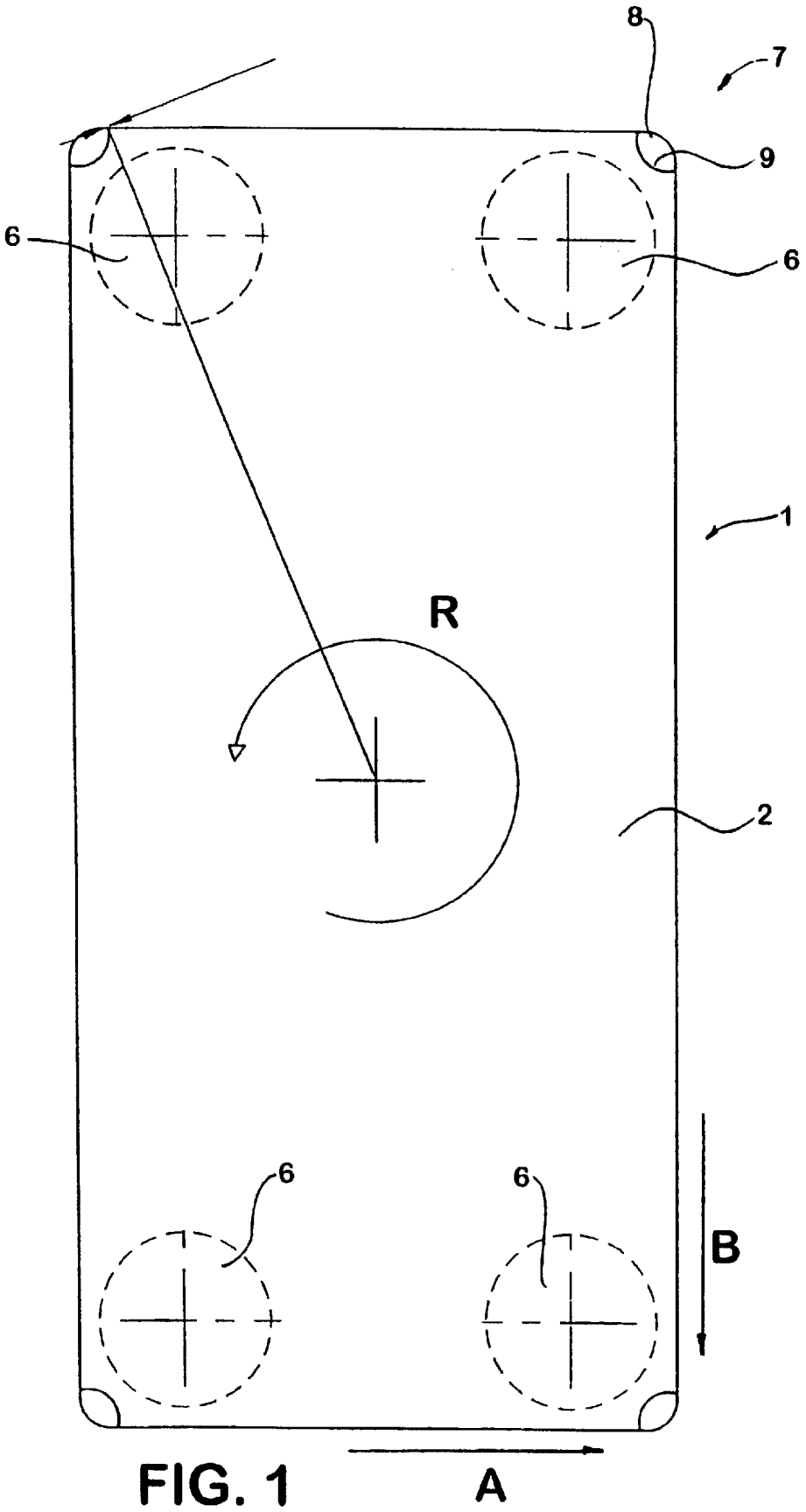
FIG. 1 is a schematic end view of the plate heat exchanger according to the invention.

The novel plate heat exchanger 1 shown in FIG. 1 comprises a plurality of rectangular plate elements 2 and intermediary gaskets 3 held clamped in a stack 4 by means of traditional clamping means, which may e.g. be in the form of end plates and interconnecting bolt stringers. The plate elements 2 and intermediary gaskets 3 define flow channels 5 for the heat exchanging media flowing through the plate heat exchanger 1. The flow channels are filled with heat exchanging media via aligned inflow and outflow openings 6 in the plate elements 2.

Each corner 7 of each plate element 2 in the stack 4 comprises depressed corner areas 8 which are connected to the inner plate area at a bending line 9. The bending line 9 extends from one peripheral plate edge 10 to the other adjacent peripheral plate edge 11 of the corner 7, with a concave extent in relation to the inner plate area. This is taken to mean that the bending line deviates from a straight line to the inner plate area side of that line. The bending line extends essentially to the peripheral plate edges, but can, within the scope of the invention terminate, at some distance from the edges, as long as the extent of the line is still concave in relation to the inner plate area.

Figure 2:
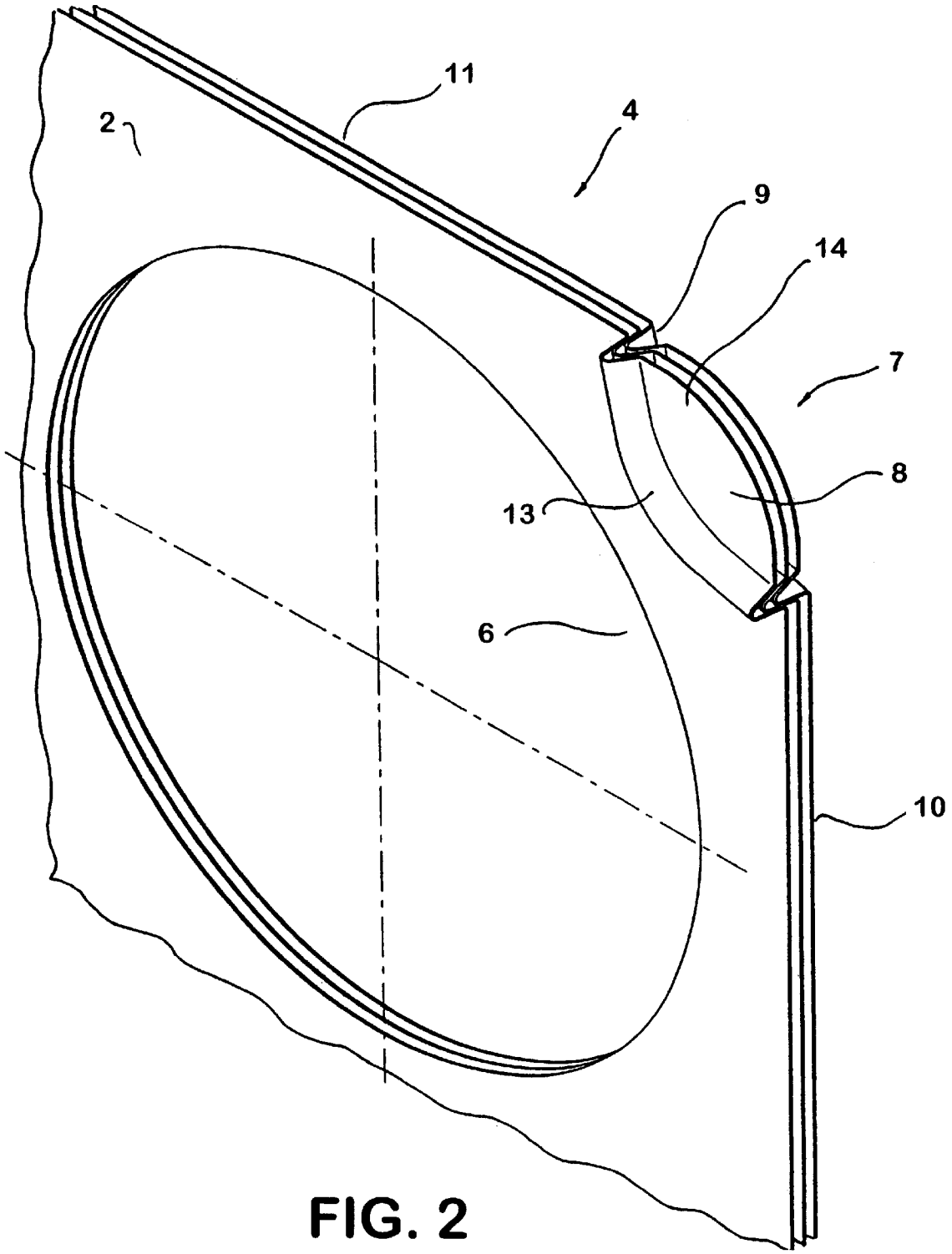
FIG. 2 is a perspective view of part of the corners of three succeeding plates in the heat exchanger stack of FIG. 1.

In the embodiment shown in FIGS. 1 and 2, the concave extent of the bending line 9 is an arc of a circle, the centre of which is situated essentially at the intersection of the extent of the two adjacent peripheral plate edges 10, 11 of the corner. This means that the bending line 9 meets the plate edges 10, 11 at a right angle.

Figure 3:
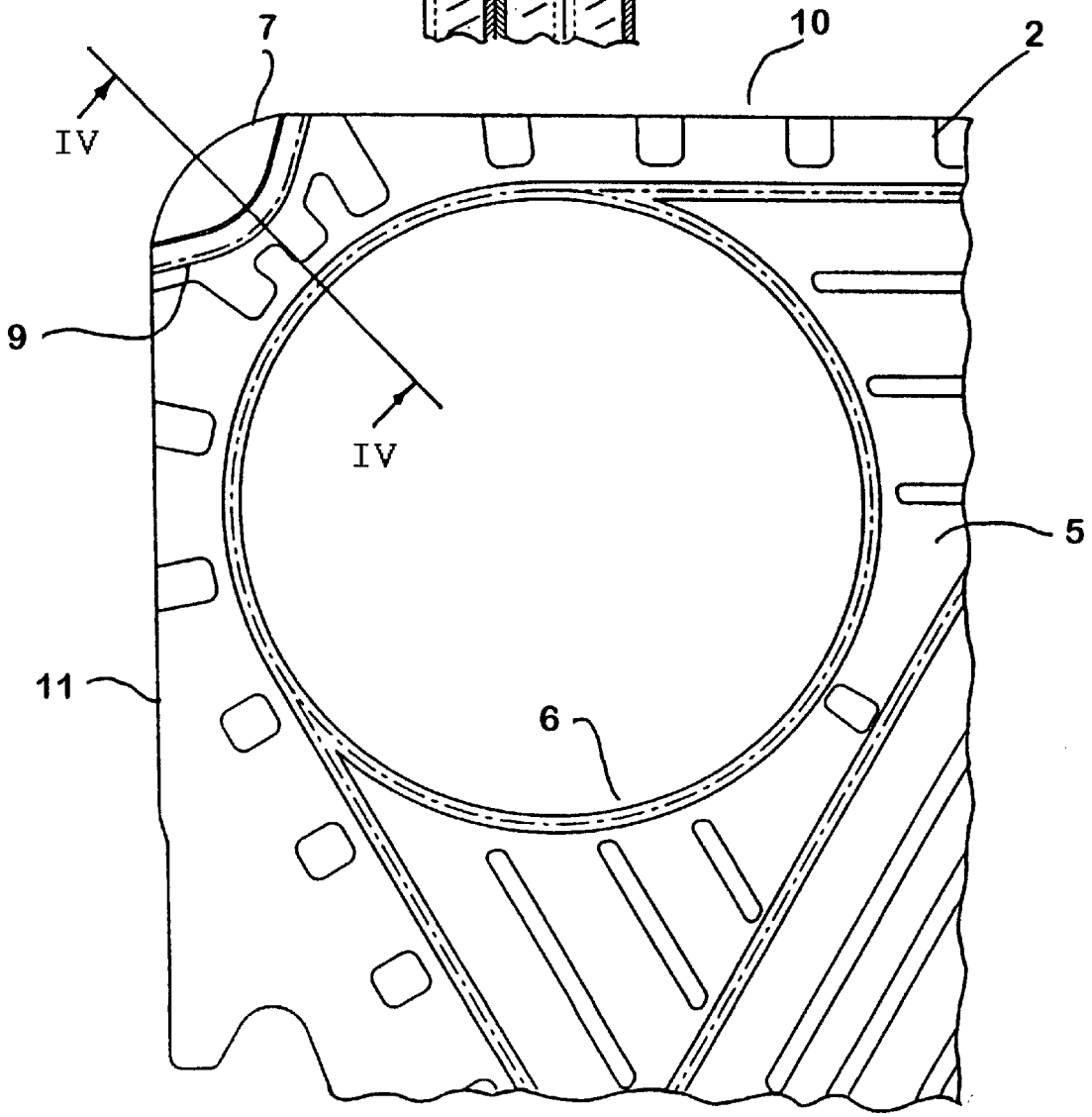
FIG. 3 is a more detailed end view of part of a plate element corner of another embodiment.

Other forms of the concave bending line extent comprise compositions of line pieces with different forms, such as compositions of straight line pieces and curved line pieces. Such an embodiment is shown in FIGS. 3 and 4 where the bending line is curved in the middle of its extent, and is straight at the ends of its extent meeting the plate edges.

Figure 4:
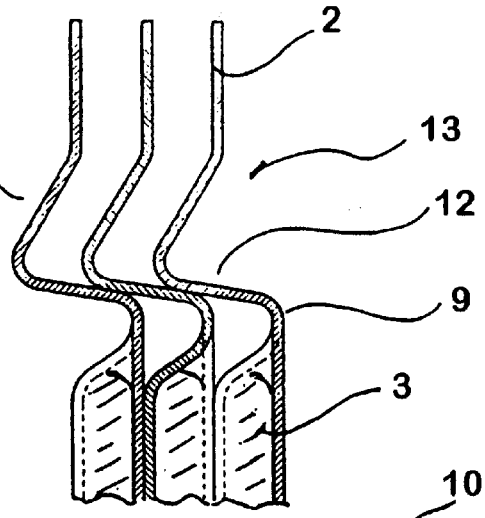
FIG. 4 is a sectional view along the line IV—IV in FIG. 3.

The depressed corner areas comprise a collar part 12 extending obliquely with respect to the plate surface, FIG. 4. The collar part 12 is part of a corrugation 13 giving further strength and stability to the depressed plate corner area. The depressions of the corrugation 13 are lower than any other depressions of the remaining inner plate area. The plate element terminates at the corner at a flat plate piece 14, which can be omitted.

The plate elements are manufactured by conventional pressing tools, but it should be emphasized that it was a great surprise to the skilled person within the field of plate pressing technology that the necessary plate material volume during the tested pressing actions was drawn in a uniform way from the inner plate area and into the concave bending line area.

The positive engagement between the outer contours of diagonally opposed corners 7 of a plate element 2 and the inner contours of diagonally opposed corners 7 of the next following plate element 2 in the stack 4, ensure a fast assembly of the plate heat exchanger, where the plates are in a safe manner guided into engagement with each other. The concave bending line extent 9 of the depressed corner areas furthermore ensures that the plates 2 are always in firm interlocking engagement with each other, preserving alignment of the stack irrespective of dimensional plate variations within the production tolerances.

Testing of the inventive plate heat exchanger 1 under extreme heat and pressure conditions has shown a surprisingly stable and reliable alignment of the plates 2 in the stack 4, with negligible transverse displacement of the plates, both in transverse directions A, B parallel to the edges 10, 11 of the plates 2 as well as in rotational directions R round the inner plate area, FIG. 1.

Testing has further shown that alignment of the stack is preserved although the geometrical dimensions of the plate contours, as well as of the plate thickness, vary. In comparison to the known alignment arrangements, alignment of the novel heat exchanger stack can be preserved within acceptable levels for a broader set of dimensional production tolerances of the plate elements.

We claim:

1. A plate heat exchanger comprising a plurality of rectangular plate elements and intermediary gaskets to be held clamped in a stack, wherein the plate elements and gaskets define flow channels for the heat exchanging media flowing through the plate heat exchanger, which flow channels are to be filled via aligned inflow and outflow openings in the plate elements, wherein at least two diagonally opposed corners of each plate in the stack have depressed corner areas comprising collar parts, which are connected to the inner plate area at a bending line, which line extends substantially from one peripheral plate edge to the other adjacent peripheral plate edge of the corner with a concave extent in relation to the inner plate area, and wherein the outer contour of the collar parts of a plate element in the stack is in positive engagement with the inner contour of the collar parts of the next following plate element in the stack.

2. The plate heat exchanger of claim 1, wherein the concave extent of the bending line is arched.

3. The plate heat exchanger of claim 2, wherein the concave extent of the bending line is an arc of a circle.

4. The plate heat exchanger of claim 3, wherein the centre of the circle is situated essentially at the intersection of the extents of the two adjacent peripheral plate edges of the corner.

5. The plate heat exchanger of claim 1, wherein the collar parts extend obliquely with respect to the plate surface.

6. The plate heat exchanger of claim 1, wherein the depressed corner areas comprise a corrugation.

7. The plate heat exchanger of claim 1, wherein all four corners of the plate elements comprise depressed corner areas.

8. The plate heat exchanger of claim 1, wherein the depressions of the corner areas are lower than any other depressions of the remaining inner plate area.

* * * * *